US006943650B2

(12) United States Patent
Ramprasad et al.

(10) Patent No.: US 6,943,650 B2
(45) Date of Patent: Sep. 13, 2005

(54) ELECTROMAGNETIC BAND GAP MICROWAVE FILTER

(75) Inventors: Ramamurthy Ramprasad, Phoenix, AZ (US); Michael F. Petras, Phoenix, AZ (US)

(73) Assignee: Freescale Semiconductor, Inc., Austin, TX (US)

( * ) Notice: Subject to any disclaimer, the term of this patent is extended or adjusted under 35 U.S.C. 154(b) by 126 days.

(21) Appl. No.: 10/447,448

(22) Filed: May 29, 2003

(65) Prior Publication Data

US 2004/0239451 A1 Dec. 2, 2004

(51) Int. Cl.[7] ..... H01P 1/20
(52) U.S. Cl. ..... 333/202; 333/195
(58) Field of Search ..... 333/202, 195, 333/204, 219, 203; 505/210

(56) References Cited

U.S. PATENT DOCUMENTS 5,115,216 A * 5/1992 Hikita et al. ..... 333/195
5,818,309 A 10/1998 De Los Santos
6,825,741 B2 * 11/2004 Chappell et al. ..... 333/202

FOREIGN PATENT DOCUMENTS

WO WO 01/84663 11/2001

* cited by examiner

*Primary Examiner*—Lam T. Mai
(74) *Attorney, Agent, or Firm*—James L. Clingan, Jr.

(57) ABSTRACT

A microwave filter is formed from an electromagnetic band gap structure. The electromagnetic band gap structure includes a periodic array of metal features (16, 42, 44, 50) formed within a dielectric matrix (14, 52). A defect feature (17, 48) is formed within the periodic array of metal features (16, 42, 44, 50) in order to create a pass band within a stop band region.

8 Claims, 6 Drawing Sheets

ELECTROMAGNETIC BAND GAP MICROWAVE FILTER

FIELD OF THE INVENTION

The present invention relates to the field of electronic filters, and more particularly to filters constructed from materials having an electromagnetic band gap.

BACKGROUND OF THE INVENTION

Filters are widely employed to modify the frequency response of electronic circuits. Filters typically use pass or stop bands to modify the frequency response of a circuit by selectively transmitting or attenuating one or more frequencies within a spectrum. Filters may exhibit low pass, high pass, band pass, and band rejection attributes.

Wireless communications has greatly crowded the electromagnetic spectrum. Such signal congestion has increased the demand for high performance electronic filters. In particular, filters that function at microwave frequencies are particularly important in wireless communications. Designing passive RF components in the microwave region is, however, particularly challenging. For wireless applications, notch filters that have a narrow band pass region are particularly useful. Competent notch filters exhibit accurate frequency selectivity and low insertion losses. The issue of insertion losses is of particular concern in portable wireless devices that rely on batteries for power.

Electromagnetic Band Gap ("EBG") structures offer an expedient solution to the wireless communications demand for high performance notch filters. EBG structures function as a filter by exploiting their inherent electromagnetic band gap. At frequencies outside of the band gap, EBG structures pass signals. However, at frequencies that are within the band gap, EBG structures block the transmission of the signal.

The band gap behavior of EBG structures, also commonly referred to as photonic crystals, arises from the periodicity of the crystal lattice that forms the EBG structure. There are a variety of ways to fabricate the lattices that form EBG structures. One such method includes forming periodic inclusions in a dielectric matrix. Another method is to form a lattice of metal balls within a dielectric matrix.

Whatever method is used to create the EBG structure, the formation of the electromagnetic band gap arises in much of the same way as it does in semiconductor materials. When electromagnetic waves propagate through a periodic structure or array, Bragg diffraction creates destructive interference between the waves at particular frequencies. This Bragg diffraction gives rise to the band gap of the structure or material. EBG structures exhibit a characteristic band gap that has a center frequency related to the lattice constant of the periodic array. Specifically, the center frequency of this characteristic band gap is proportional to the speed of light divided by twice the lattice constant multiplied by the square root of the dielectric constant of the embedding medium.

EBG structures are commonly used in optical communications devices. For optical applications, EBG structures are sized to enable on-chip integration. For the characteristic band gap to occur at optical frequencies, the overall EBG structure lattice should have a size on the order of microns. The high demands placed on filters for wireless communications applications has generated interest in the use of EBG structures at the microwave portion of the electromagnetic spectrum. However, for the characteristic band gap to occur at microwave frequencies such as 10 GHz, for example, the overall EBG structure lattice needs to have a relatively large size, on the order of centimeters. This relatively large size makes the use of EBG structures for microwave communications, particularly with portable wireless devices, problematic.

Even so, the use of EBG structures for wireless communications filters has numerous advantages. First, EBG filters have low losses, making them ideal for high quality radio frequency (RF) applications. In addition, the low cost of manufacturing EBG structures makes them highly competitive with other components. Consequently, there is a need to develop smaller EBG structures that are useful in microwave communications applications.

DETAILED DESCRIPTION OF A PREFERRED EMBODIMENT

Figure 1:
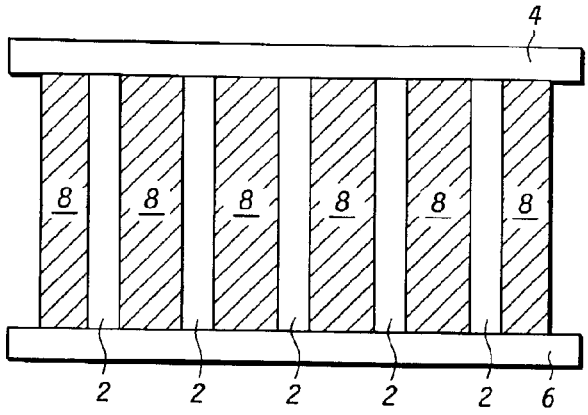
FIG. 1 illustrates a one dimensional periodic structure that exhibits an electromagnetic band gap as understood by one of ordinary skill in the art.

Electromagnetic Band Gap (EBG) or Photonic Band Gap (PBG) crystals offer a powerful method of controlling the propagation of Electromagnetic (EM) waves. To understand the basic concepts involved, we draw an analogy with electronic semiconductor materials. Crystalline semiconductors are composed of a periodic arrangement of a basic building block of atoms. Therefore, a crystal in this context can be considered a periodic potential that a propagating electron encounters. Thus, the geometry and symmetry of the crystal dictates many of the conduction properties of the crystal. In particular, due to Bragg-like diffraction from the periodic potential, electrons are forbidden to propagate with certain energies in certain directions. If the periodic potential is strong enough, the gap might extend to all possible directions resulting in a complete band gap. For instance, an insulator has a complete band gap between the valence and conduction energy bands.

In EBG or PBG crystals, the periodic "potential" is due to a lattice of macroscopic inclusions that have different EM properties compared to the background medium in which the inclusions are embedded. EM properties include the permittivity (i.e., the dielectric constant), permeability, and conductivity. If the EM properties of the inclusions are sufficiently different from those of the background medium, and the absorption of the EM waves by these materials is minimal (i.e., if the materials are low loss), then scattering of EM waves by the periodic array of inclusions results in many phenomena analogous to those in periodic semiconductors. In particular, band gaps are produced that forbid the propagation of EM waves with certain frequencies along certain directions creating what are called EBGs or PBGs in the associated "band structures".

An example of a widely used device that uses the EBG concept is the dielectric mirror, which is essentially a quarter-wave stack of alternating layers of materials each with a different dielectric constant. EM waves of the right wavelength incident normally to this stack are completely reflected due to destructive interference of multiple scattered waves at the various internal interfaces. The dielectric mirror is thus an example of a one-dimensional dielectric EBG lattice, and so displays a band gap for only normally incident waves. Two- and three-dimensional lattices of the proper type are required to ensure band gaps along more than one (or all) directions of wave propagation.

An analogy between electronic crystals and EBG crystals can be taken further in order to understand the origins of "defect states" in the band gap. Just as defects such as vacancies, impurities, dislocations, etc., create defect states in the band gap of semiconductors, analogous defects in EBG lattices create passband features in their band gaps enabling EM waves to propagate at those specific frequencies.

It turns out that some "metallodielectric" EBG lattices display a zeroth order band gap. Metallodielectric lattices are structures that contain a periodic arrangement of metallic inclusions embedded in a dielectric matrix. Most metals exhibit large losses at optical frequencies, the frequency range relevant for opto-electronic applications. However, at microwave frequencies most metals display negligible losses. Therefore, metallodielectric structures offer the opportunity of designing low loss microwave devices which could also be small enough to enable practical applications owing to the existence of the zeroth order band gap.

Referring to the Figures by characters of reference, prior art FIG. 1 illustrates a one dimensional periodic structure that exhibits an electromagnetic band gap as understood by one of ordinary skill in the art. In FIG. 1, the EBG structure is embedded in a microstrip transmission line. This EBG structure is realized as an array of vias 2 connecting a signal line 4 to a ground line 6 (shunt). Signal line 4 and ground line 6 form the micro-strip transmission line. Vias 2 are formed in a dielectric matrix 8 that lies between signal line 4 and ground line 6. Together, vias 2 and dielectric matrix 8 form the EBG structure. The periodicity of vias 2 within dielectric matrix 8 gives rise to an electromagnetic band structure that can be exploited for filtering applications.

It is possible to significantly shrink EBG structures for microwave applications through introducing metallic vias 2 into dielectric matrix 8, resulting in a metallo-dielectric lattice. The proximity of vias 2 creates periodic capacitive coupling between metallic vias 2. This capacitive coupling between vias 2 decreases a lower band edge of the band gap of EBG structure to frequencies that are lower than those achievable without capacitive coupling. While metallic vias 2 create significant losses at optical frequencies, vias 2 show negligible losses at microwave frequencies. As a result, for microwave applications, the EBG structure is nearly lossless.

Figure 2:
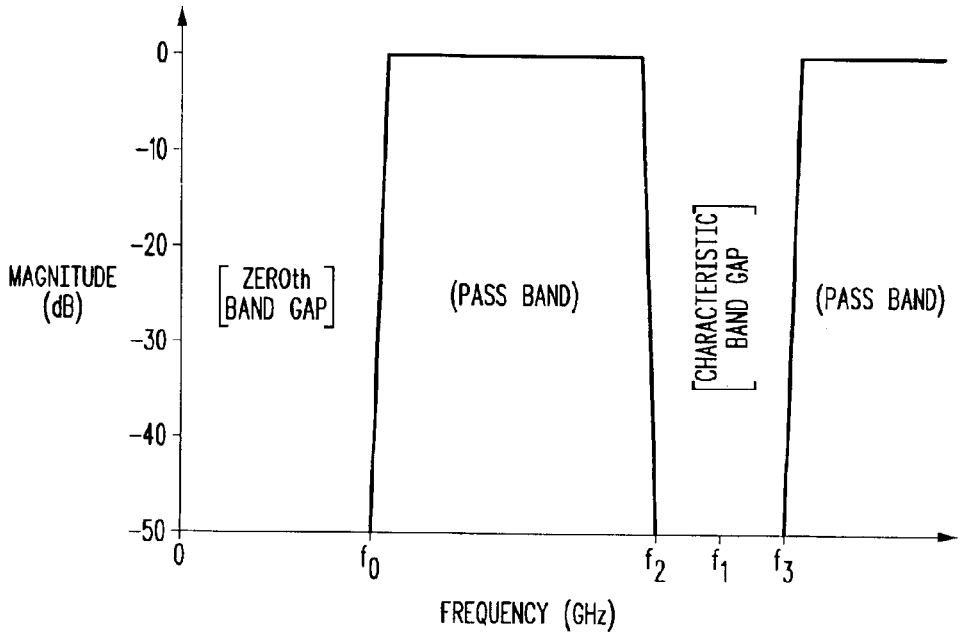
FIG. 2 illustrates a transmission spectrum of the one dimensional periodic structure illustrated in FIG. 1 also as understood by one of ordinary skill in the art.

Prior art FIG. 2 illustrates the transmission spectrum of the one dimensional EBG structure illustrated in FIG. 1 as understood by one of ordinary skill in the art. EBG structures exhibit a frequency response which has a center frequency ($f_1$) related to the lattice constant of the periodic array. Signals with frequencies that lie within the band gaps are prevented from propagating between the signal line 4 and ground line 6. Referring to FIG. 1, the lattice constant is the distance between vias 2. Specifically, the relation of this center frequency ($f_1$) of the characteristic band gap is given by Equation 1 below:

$$f_1 \approx c/(2a\sqrt{(\in\mu)}) \qquad \text{Equation 1}$$

where "c" is the speed of light in a vacuum, "a" is the lattice constant of EBG structure, and "$\in$" and "$\mu$" are the relative permittivity and permeability, respectively, of dielectric matrix 8. The EBG structure formed by vias 2 and dielectric matrix 8 exhibits a band gap in the transmission spectrum illustrated in FIG. 2 at frequencies near this center frequency. Frequencies that lie within the band gap are blocked from transmission through the EBG structure. Referring to FIG. 1, frequencies that lie within characteristic band gap are blocked from transmission between signal line and ground line by the EBG structure. As a result, the EBG structure filters the frequencies from the micro-strip transmission line that lie within the characteristic band gap.

The EBG structure also exhibits a second band gap lower in frequency than the characteristic band gap. This second band gap, referred to as zeroth order band gap, extends from DC to a cut-off frequency $f_0$. This zeroth order band gap exists in addition to the characteristic band gap. Two-dimensional arrays of metallic posts 2 formed in a dielectric matrix 8 also give rise to the zeroth order band gap. This stop band from zero frequency to $f_0$ is created from the interaction with vias 2 of electromagnetic waves with electric field vectors that are parallel to vias 2. The value of $f_0$ is determined by the fractional value that metallic vias 2 have in overall EBG structure volume.

For filtering applications, the EBG structure exhibits two stop bands, the zeroth band gap and the characteristic band gap. The first stop band, which is the zeroth band gap, ranges from zero frequency to $f_0$. The second stop band, which is the characteristic band gap, is centered over center frequency $f_1$, and ranges from $f_2$ to $f_3$. Between $f_0$ and $f_2$ exists a pass band. Between $f_2$ and frequency $f_3$ there is a second pass band. Utilizing the characteristic band gap ranging from frequencies $f_2$ to $f_3$ for microwave filtering applications is feasible. Operating within this characteristic band gap for microwave applications, however, requires that the EBG structure have a size on the order of centimeters. Being this big is highly undesirable for portable wireless devices. As a result, operating in the zeroth band gap for microwave applications is desirable.

Figure 3:
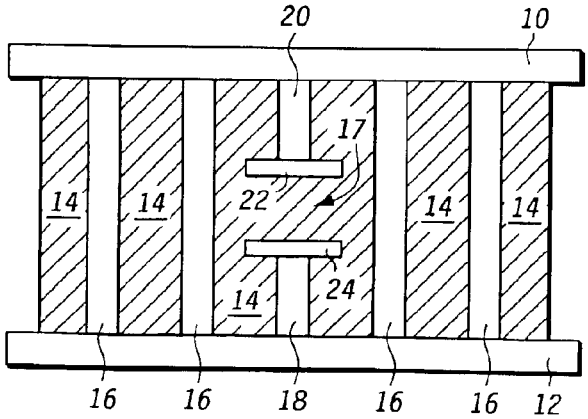
FIG. 3 illustrates a structure devised in accordance with an embodiment of the invention.

FIG. 3 illustrates an embodiment of the invention. A preferred micro-strip transmission line includes signal line 10 and ground line 12. Between signal line 10 and ground line 12 is a filter formed in a dielectric matrix 14. The filter is created with a series of metal posts 16 that are identically spaced in dielectric matrix 14 to create a periodic lattice. Metal posts 16 may be preferably formed from vias 16 that are produced in dielectric matrix 14. Metal posts 16 form a periodic metal lattice within dielectric matrix 14. For an example of printed circuit board applications, vias 16 may be spaced at a distance of 1.5 mm, thereby giving the lattice of filter a lattice constant of 1.5 mm. For a typical case, there is a 1 mm distance between signal line and ground line within circuit boards. Note that these dimensions are merely exemplary for illustrative printed circuit board embodiment. Other dimensions may exist for other printed circuit board applications and other transmission line embodiments such as in a system on a chip applications. Such dimensions may be greater or smaller than these described for this example.

Figure 4:
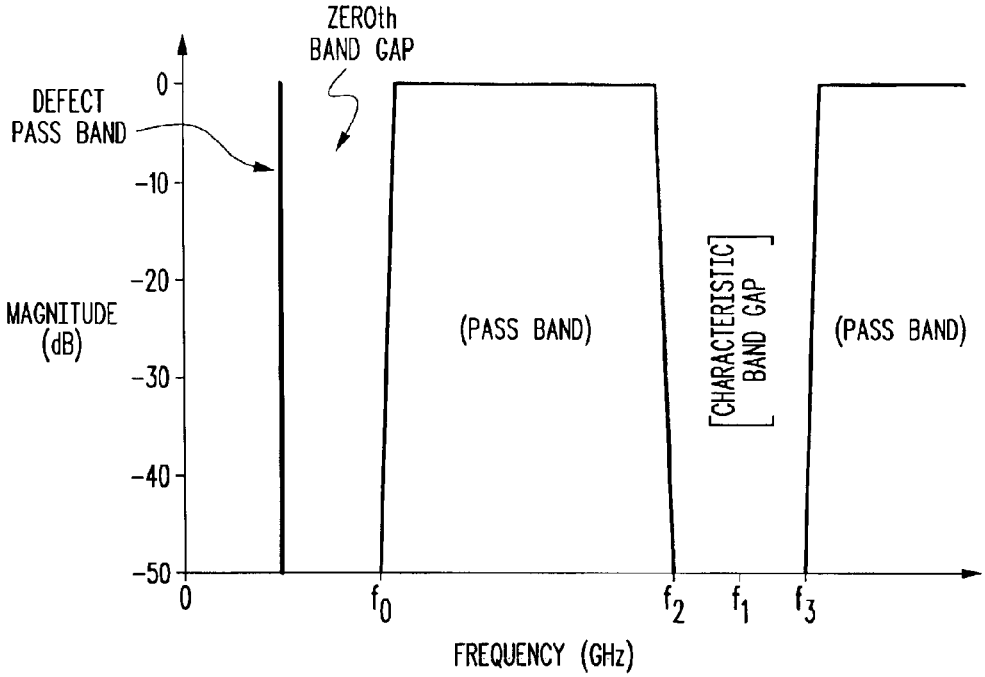
FIG. 4 illustrates a transmission spectrum exhibited by the structure of FIG. 3.

FIG. 4 illustrates a transmission spectrum of the structure of FIG. 3. The periodic lattice formed by vias 16 generates the transmission spectrum illustrated in FIG. 4. The spectrum illustrated in FIG. 4 exhibits a zeroth stop band beginning at DC and extending to frequency $f_0$. The frequency $f_0$, at which zeroth band gap stops, is determined by the fractional volume of the filter that is consumed by vias 16. The center frequency of the characteristic band gap extends from $f_2$ to $f_3$, with the center frequency $f_1$ as defined above in terms of the lattice constant of the filter.

A highly selective pass band is created in the zeroth stop band through the inclusion of a defect feature 17 illustrated in FIG. 3. Thus, all signals with frequencies between 0 and $f_0$ propagating between the signal line 10 and ground line 12 are blocked from transmission except signals with frequencies corresponding to the pass band created by the defect feature 17. Referring to FIG. 3, defect feature 17 is formed from dividing one via into two separate posts 18 and 20. At the ends of posts 18 and 20 are metal plates 22 and 24, respectively. Together, posts 18 and 20 and plates 22 and 23 form defect feature 17. The presence of defect feature 17 has the effect of creating a highly selective zeroth stop band as illustrated in FIG. 4.

The presence of a single defect feature 17 is merely exemplary. Depending upon the width and location of the desired pass band, multiple defect features 17 can be introduced into the EBG lattice. For example, if the EBG filter has a lattice constant of 1.5 mm, a distance of 1 mm between signal line 10 and ground line and 12, and vias 16 with an inductance of 0.4 nH, it would have a characteristic frequency ($f_1$) of approximately 100 GHz and a zeroth band gap ranging from zero frequency to a stop band cutoff frequency $f_0$ of 25 GHz. Introducing defect feature 17 having an exemplary 0.7 pF capacitance across plates 22 and 24 creates a pass band at approximately 8 GHz within zeroth band gap. Through varying the inductance of posts 16, 18, and 20 and capacitance of plates 22 and 24, it is possible to move the frequency of pass band within the zeroth band gap. Several methods known in the art exist for varying the inductance of the posts and the capacitance of the defects. For instance, the capacitance can be varied by changing the size of the plates 22 and 24 and/or by varying the distance between the plates 22 and 24.

Figure 5:
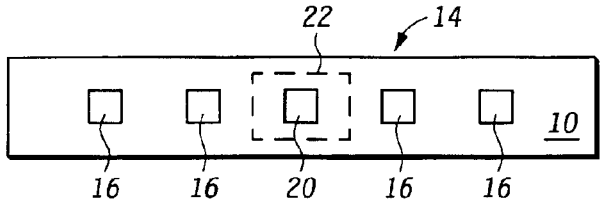
FIG. 5 illustrates a top view of the structure of FIG. 3.

FIG. 5 illustrates a top view of the structure of FIG. 3. Signal line 10 is visible. Along the length of signal line are vias 16 formed through dielectric matrix 14 that lies below signal line 10. Vias 16 electrically couple signal line 10 to ground line 12 as illustrated in FIG. 3.

Figure 6:
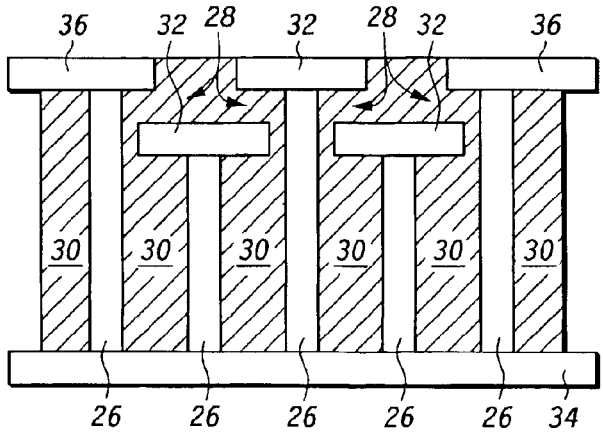
FIG. 6 illustrates a one dimensional periodic structure that produces an electromagnetic band gap according to another embodiment of the invention.

FIG. 6 illustrates another embodiment of the invention that is a periodic structure that produces an electromagnetic band gap. A filter is made from a periodic array of metal posts 26 and capacitive-like elements 28 formed in a dielectric matrix 30. At the top of each metal post 26 is a metal plate 32. This filter is coupled to a microstrip transmission line that has a ground line 34 and a signal line 36. Plates 32 that are at adjacent lattice sites are at different heights relative to ground line 34 and couple capacitively with each other. Plates 32 are coupled to metal posts 26 that shunt the capacitive elements to ground. Plates 32 form a break in signal line 36. Together, plates 32, metal posts 26, and dielectric matrix 30 form an electromagnetic band gap filter. Note that in this embodiment, plates 32 form a periodic array of capacitors in series, with periodic inductive shunt elements 26. The values of the capacitances and inductances can be varied by appropriate variations of the geometry of the individual elements. For instance, the capacitance value can be changed by altering the size of plates 32 and/or by altering the distance between adjacent plates 32.

Figure 7:
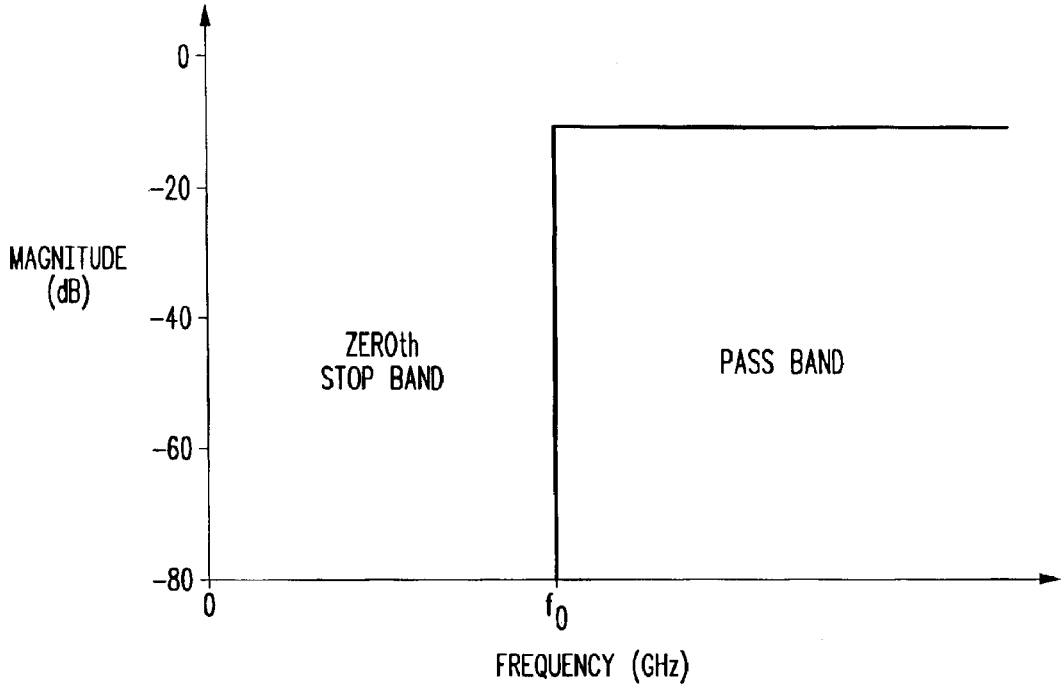
FIG. 7 illustrates a transmission spectrum of the one dimensional periodic structure illustrated in FIG. 6.

FIG. 7 illustrates a transmission spectrum of a one dimensional version of the periodic structure illustrated in FIG. 6. The periodic structure of capacitive-like elements 28 illustrated in FIG. 6 which couple capacitively with their neighbors produces a zeroth order band gap that begins at zero frequency and ends at frequency $f_0$. The transmission characteristics of the structure illustrated in FIG. 6 show that it is a high pass filter. The capacitor-like structure of FIG. 6 blocks frequencies below $f_0$, and passes frequencies above $f_0$. As with the embodiment of FIG. 1, the value of $f_0$ is a function of the electromagnetic properties of the materials used to construct the device. By varying the size of metal posts 26, metal plates 32, and dielectric matrix 30, it is possible to control the bandwidth of zeroth order band gap. Consequently, it is possible to manufacture filters having a particular frequency response for a desired application.

Figure 8:
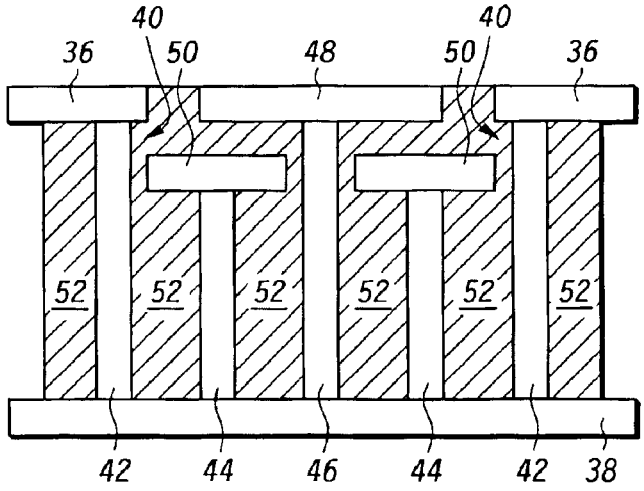
FIG. 8 illustrates a variation to the structure of FIG. 6.

FIG. 8 illustrates a variation on the EBG structure illustrated in FIG. 6, but which contains a defect feature. Referring to FIG. 8, there is shown a micro-strip transmission line with a signal line 36 and a ground line 38. Between signal line 36 and ground line 38 is an electromagnetic band gap filter. The filter is formed by a periodic array of capacitive-like elements 40 composed of plates 48 or 50 attached to vias 46 or 44, respectively. Vias 42, 44, and 46 are metal posts that have an inductance, and are shunted to ground line 38. Adjacent posts are of different heights to enable capacitive coupling between adjacent plates. Plates 50 and 48 form a periodic array of capacitors within dielectric matrix 52. The periodic series of capacitances and the inductive shunts 42, 44 and 46 create an electromagnetic band gap filter having a zeroth band gap. The defect feature in this embodiment takes the form of an oversized capacitor plate 48. Oversized capacitor plate 48 creates a different level of capacitance in the otherwise periodic series of capacitors 40. As a result of this differing level of capacitance, a band pass region is created in zeroth order band gap.

Figure 9:
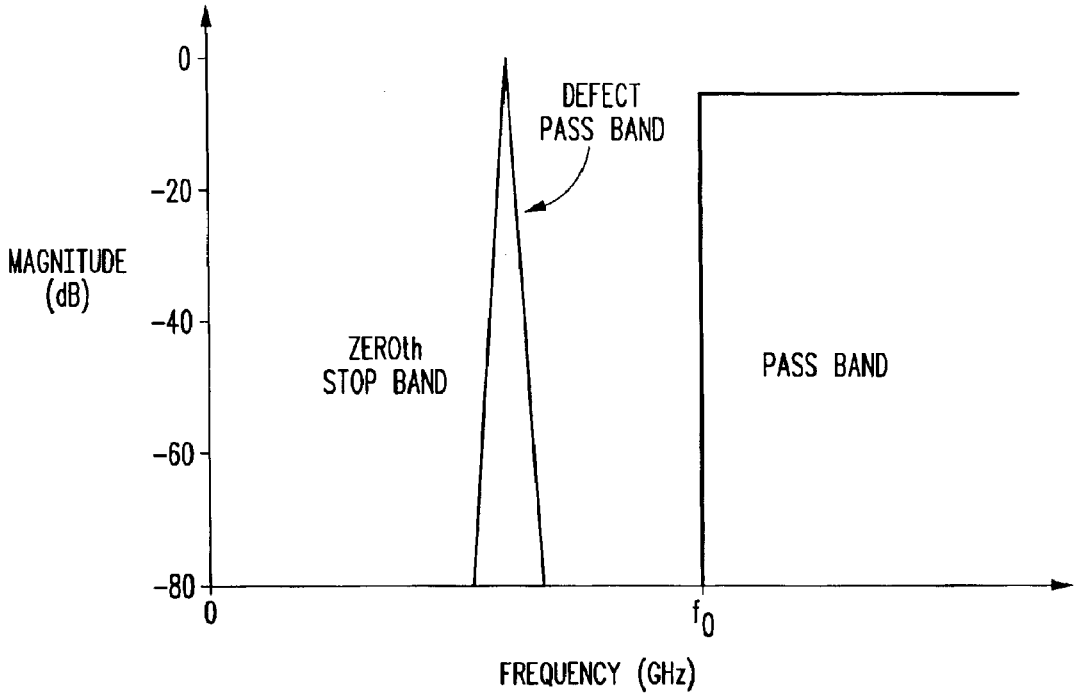
FIG. 9 illustrates a transmission spectrum of the structure of FIG. 8.

FIG. 9 illustrates a transmission spectrum of the structure of FIG. 8. As with the transmission spectrum illustrated in FIG. 7, the transmission spectrum illustrated in FIG. 9 has a zeroth order band gap extending from zero frequency to $f_0$. The defect feature formed from oversized capacitor plate 48 creates a defect band pass region within the zeroth order band gap. The band width and location of the defect band pass region as well as the frequency selectivity of the band pass region are determined by the features of oversized capacitor plate 48 and the number of defect features in the filter. By altering the size of oversized capacitor plate 48, it is possible to control the bandwidth and amplitude of the band pass region. In FIG. 8, a single exemplary defect feature is illustrated. The filter can have numerous defect features formed from using oversized capacitor plate 48 periodically positioned within the original capacitor lattice. Note that the use of an oversized capacitor plate 48 to form defect feature is also exemplary. Other methods of creating a defect structure include (but are not limited to) varying the height of one of the metal posts 46 to either increase or decrease the distance between capacitor plates 36, 48, and 50, or using an undersized capacitor plate 48 rather than an oversized plate.

Figure 10:
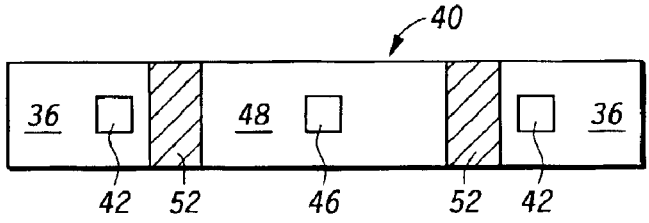
FIG. 10 illustrates a top view of the structure of FIG. 8.

FIG. 10 illustrates the top view of the structure of FIG. 8. In this top view, signal line 36 of a micro-strip transmission line is illustrated as having a series of plates 48 and 50 (plate 50 is not seen in FIG. 10 but is illustrated in FIG. 8). Plates 48 and 50 are capacitively coupled with each other (shown as component 40 in FIG. 8) and are shunted to ground line 38 by metal posts 42, 46, and 44 (ground line 38 and post 44 are not seen in FIG. 10 but illustrated in FIG. 8) at varying heights. A dielectric matrix 52 is formed surrounding plates 48 and 50 and posts 42, 44 and 46 between signal line 36 and ground line 38. This periodic array of capacitors (component 40) and inductive shunts (components 42, 44 and 46) forms an electromagnetic zeroth order band gap, as illustrated in FIG. 9.

Figure 11:
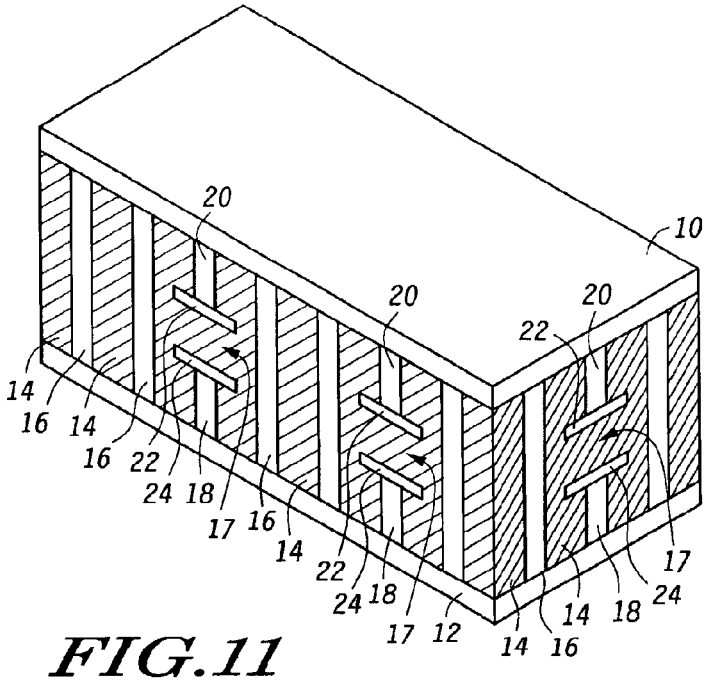
FIG. 11 illustrates a perspective view of a two dimensional embodiment of the invention.

FIG. 11 illustrates a perspective view of a two dimensional analogue of the structures illustrated in FIGS. 3 and 5. Fabricating the one dimensional embodiment of the filter illustrated in FIGS. 3 and 5 as a single row of vias 16 formed within a dielectric matrix 14 with a single defect feature 17 is merely exemplary. It is possible to fabricate two dimensional electromagnetic band gap filters using multiple rows of vias 16 formed within a dielectric matrix 14. Further, within each row of vias 16, multiple defect features 17 can be formed by replacing a via 16 by two smaller vias 18 and 20 and two plates 22 and 24. Such a periodic structure with defect features 17 also has a transmission spectrum similar to the one illustrated in FIG. 4, which shows a zeroth order band gap extending from zero frequency to $f_0$. The presence of the defect features 17 results in the defect induced pass band in the zeroth order band gap. Characteristics of this pass band, such as its location and bandwidth, can be controlled by the number of the capacitive defects, and the values of the post or via inductance and defect capacitances. Several methods exist for varying the inductance of the posts and the capacitance of the defects. For example, the capacitance can be varied by changing the size of the plates 22 and 24 and/or by varying the distance between the plates 22 and 24.

In the absence of defect features, the transmission spectrum would be similar to the illustration in FIG. 2. An important implication of two (or three) dimensional periodic lattices is that the band gaps for EM waves traveling along different directions could be different, as the EM waves see lattices with different periodicities along different directions. This attribute is expected to provide additional design flexibility.

Figure 12:
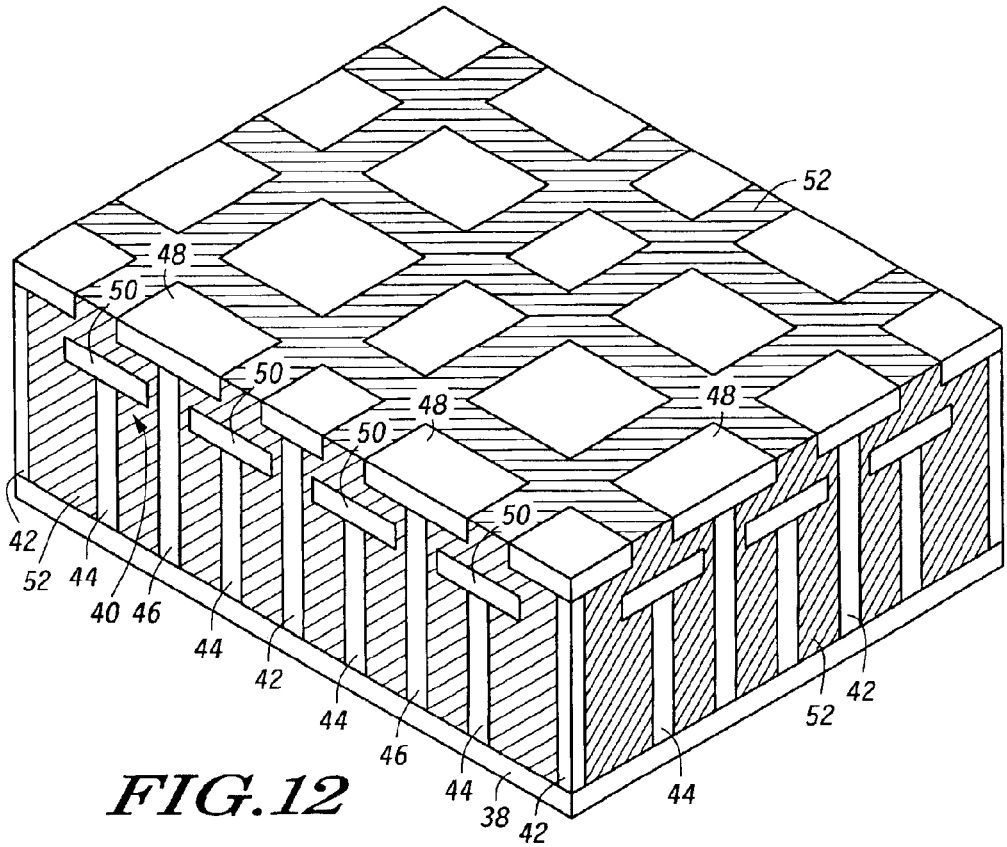
FIG. 12 illustrates a top view of another two dimensional embodiment of the invention.

FIG. 12 illustrates a perspective view of a two dimensional analogue of the structures of FIGS. 8 and 10. Fabricating the one dimensional embodiment of the filter illustrated in FIGS. 3 and 5 as a single row of vias 42, 44, and 46 formed within a dielectric matrix 52 with a single defect feature 48 is merely exemplary. It is possible to fabricate two dimensional electromagnetic band gap filters using multiple rows of vias 42, 44, and 46 formed within a dielectric matrix 52. Further, within each row of vias 42, 44, and 46, multiple defect features 48 can be formed at periodic spacings. Such a periodic structure with defect features would have a transmission spectrum similar to the one illustrated in FIG. 9, which shows a zeroth order band gap extending from zero frequency to $f_0$. The defect feature formed from oversized capacitor plate 48 creates a defect band pass region within the zeroth order band gap. As with the one dimensional case, the band width and location of the defect band pass region as well as the frequency selectivity of the band pass region are determined by the features of oversized capacitor plate 48 and the number of defect features in filter. By altering the size of oversized capacitor plate 48, it is possible to control the bandwidth and amplitude of the band pass region. In FIG. 8, a single exemplary defect feature is illustrated. In practice, the filter can have numerous defect features formed from using oversized capacitor plate 48 periodically positioned within the original capacitor lattice. Note that the use of an oversized capacitor plate 48 to form defect feature is also exemplary. Other methods of creating a defect structure include (but are not limited to) varying the height of one of the metal posts 46 to either increase or decrease the distance between capacitor plates 48 and 50, or using an undersized capacitor plate 48 rather than an oversized plate.

In the absence of defect features, the transmission spectrum would be similar to the illustration in FIG. 7, with no defect induced pass band in the zeroth band gap. Here again, an important implication of two (or three) dimensional periodic lattices is that the band gaps for EM waves traveling along different directions could be different, as the EM waves see lattices with different periodicities along different directions. This attribute is expected to provide additional design flexibility.

Figure 13:
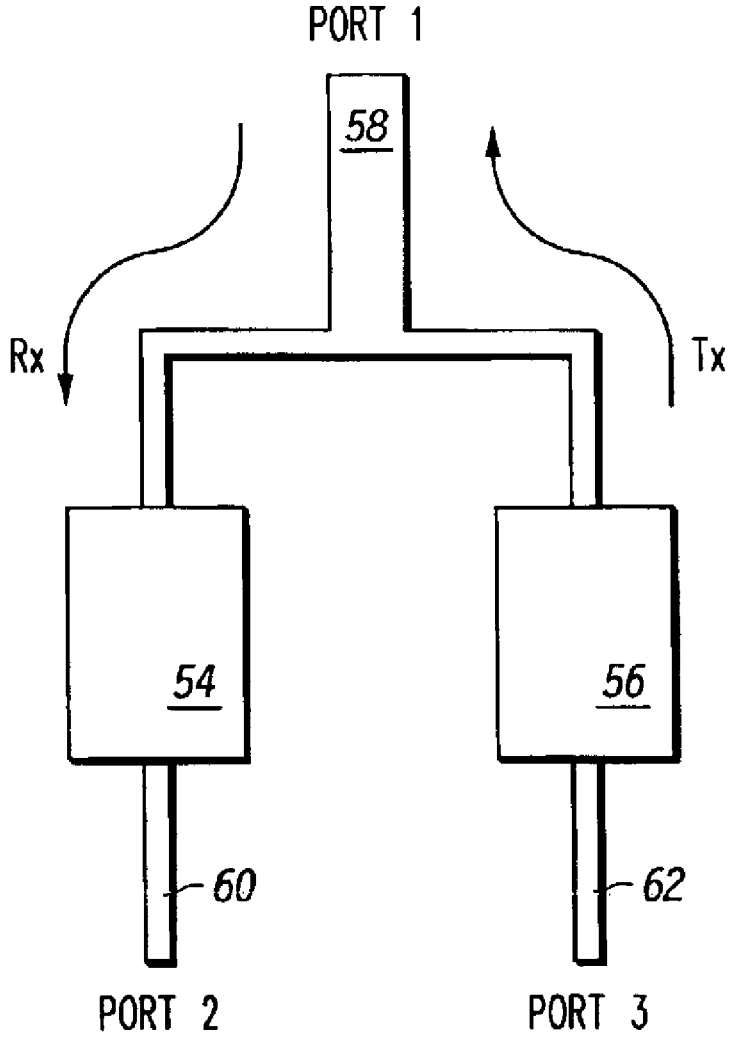
FIG. 13 illustrates a two-pass-band communications filtering device devised in accordance with any of embodiments of the invention.

Several multi-port devices can be constructed using EBG filters as building blocks, or using the concept of selective wave propagation along certain directions to result in desired multi-port characteristics. FIG. 13 illustrates a two-pass-band communications filtering device of the former type made in accordance with any embodiments of the invention. Filters 54 and 56 are implemented on either the design of FIGS. 3 and 5 or FIGS. 8 and 10. Filters 54 and 56 are provided with a defect pass band that is located at different frequencies. These different pass band frequencies are achieved through altering the size and number of defect features 17 or 48. In this manner, signals can be received at port two 60 through port one 58 at one frequency and then transmitted at a different frequency at port one 58 through port three at 62. Choosing the one dimensional embodiments for the components 54 and 56 of FIG. 13 is merely exemplary. Components 54 and 56 can be combined into a single two dimensional embodiment that has the defects chosen and placed appropriately so as to result in the desired three-port characteristics.

Although the present invention has been described in detail, it will be apparent to those of skill in the art that the invention may be embodied in a variety of specific forms and that various changes, substitutions, and alterations can be made without departing from the spirit and scope of the invention. The described embodiments are only illustrative and not restrictive and the scope of the invention is, therefore, indicated by the following claims.

We claim:

1. An electromagnetic band gap filter, comprised of:

a dielectric matrix;

a lattice formed within said dielectric matrix, that has a stop band response that includes zero frequency; and a defect feature formed in said lattice, thereby forming a pass band within said stop band at a microwave frequency;

wherein said defect feature is comprised of a capacitor placed within said periodic lattice.

2. An electromagnetic band gap filter, comprised of:

a dielectric matrix;

a lattice formed within said dielectric matrix that has a stop band response that includes zero frequency; and a defect feature formed in said lattice, thereby forming a pass band within said band at a microwave frequency;

wherein said periodic lattice is comprised of a row of metallic rods

3. An electromagnetic band gap filter, comprised of:

a dielectric matrix;

a lattice formed within said dielectric matrix that has a stop band response that includes zero frequency; and a defect feature formed in said lattice, thereby forming a pass band within said band at a microwave frequency;

wherein said periodic lattice is comprised of a row of capacitors.

4. The filter of claim 3, wherein said defect feature is comprised of a defect capacitor having a capacitance different from said capacitors forming the periodic lattice.

5. An electromagnetic band gap filter, comprised of:

a dielectric matrix;

a lattice formed within said dielectric matrix that has a stop band response that includes zero frequency; and a defect feature formed in said lattice, thereby forming a pass band within said band at a microwave frequency;

wherein said lattice is comprised of:

a row of metallic posts having alternating heights; and a plurality of metallic plates placed proximal to the ends of each metal post in said row of metal posts, wherein said metal plates overlap thereby forming a periodic array of capacitors.

6. An electromagnetic band gap filter, comprised of:

a dielectric matrix;

a lattice formed within said dielectric matrix that has a stop band response that includes zero frequency; and a defect feature formed in said lattice, thereby forming a pass band within said band at a microwave frequency;

wherein said defect is comprised of an oversized metal plate formed in the periodic lattice.

7. An electromagnetic band gap filter, comprised of:

a dielectric matrix;

a lattice formed within said dielectric matrix that has a stop band response that includes zero frequency; and a defect feature formed in said lattice, thereby forming a pass band within said band at a microwave frequency;

wherein the periodic lattice couples a signal line to a ground line, thereby selectively rejecting signals propagating through said signal line and said ground line.

8. A microwave filter, comprised of:

lattice means to form an electromagnetic band gap structure within a dielectric matrix, thereby creating a transmission spectrum having a stop band that includes zero frequency; and defect means to form a defect in said periodic metal lattice, thereby forming a pass band in said stop band at a microwave frequency;

wherein said lattice means is comprised of vias formed in said dielectric matrix.

* * * * *